US010590923B2

(12) United States Patent
Fujiwara

(10) Patent No.: US 10,590,923 B2
(45) Date of Patent: Mar. 17, 2020

(54) RECIPROCATING PUMP

(71) Applicant: Tacmina Corporation, Osaka (JP)

(72) Inventor: Nobuhiko Fujiwara, Hyogo (JP)

(73) Assignee: Tacmina Corporation, Osaka (JP)

( * ) Notice: Subject to any disclaimer, the term of this patent is extended or adjusted under 35 U.S.C. 154(b) by 208 days.

(21) Appl. No.: 15/517,862

(22) PCT Filed: Aug. 31, 2015

(86) PCT No.: PCT/JP2015/074673
§ 371 (c)(1),
(2) Date: Apr. 7, 2017

(87) PCT Pub. No.: WO2016/059898
PCT Pub. Date: Apr. 21, 2016

(65) Prior Publication Data

US 2017/0306935 A1 Oct. 26, 2017

(30) Foreign Application Priority Data

Oct. 14, 2014 (JP) ..... 2014-209756

(51) Int. Cl.
*F04B 43/02* (2006.01)
*F04B 9/04* (2006.01)
(Continued)

(52) U.S. Cl.
CPC ..... *F04B 43/026* (2013.01); *F04B 9/042* (2013.01); *F04B 9/045* (2013.01); *F04B 27/053* (2013.01);
(Continued)

(58) Field of Classification Search
CPC .. F04B 9/04; F04B 9/042; F04B 9/045; F04B 27/053; F04B 27/0538; F04B 43/025;
(Continued)

(56) References Cited

U.S. PATENT DOCUMENTS 1,331,233 A * 2/1920 Bery ..... F04B 35/00 384/429
2,118,492 A 5/1938 Clark
(Continued)

FOREIGN PATENT DOCUMENTS

CN 1667269 A 9/2005
CN 102052275 A 5/2011
(Continued)

*Primary Examiner* — Peter J Bertheaud
(74) *Attorney, Agent, or Firm* — The Webb Law Firm

(57) ABSTRACT

A reciprocating pump capable of reducing its overall size by suppressing the size of an entire drive unit. A plurality of piston parts move in the same direction and draw fluid into a plurality of pump chambers and discharge the fluid. The pump chambers are adjacent to each other. A motor has a drive shaft between the centers of piston parts located at both ends in the installation direction of the pump chambers and oriented in a direction substantially orthogonal to the installation direction of the pump chambers and substantially orthogonal to the moving direction of the piston parts. A plurality of cams are aligned adjacent each other in the axial direction on the motor drive shaft. The cams are linked to the piston parts so that the cams cause the reciprocal movement of the piston parts.

7 Claims, 7 Drawing Sheets

(51) Int. Cl.
*F04B 45/04* (2006.01)
*F04B 27/053* (2006.01)

(52) U.S. Cl.
CPC ..... *F04B 43/02* (2013.01); *F04B 45/043* (2013.01); *F04B 9/04* (2013.01)

(58) Field of Classification Search
CPC ..... F04B 43/026; F04B 43/04; F04B 45/043; F04B 45/047
USPC ..... 417/529, 539
See application file for complete search history.

(56) References Cited

U.S. PATENT DOCUMENTS 2,187,679 A * 1/1940 Chambers ..... F04B 1/00 417/419
3,981,620 A * 9/1976 Abrahams ..... F04B 11/0058 417/42
4,090,818 A * 5/1978 Hope ..... F04B 9/045 417/473
5,163,818 A * 11/1992 Betsill ..... F04B 27/005 417/18
5,997,258 A * 12/1999 Sawyer, III ..... F04B 39/0033 181/202
7,021,910 B1 * 4/2006 Huang ..... F04B 17/006 417/411
7,179,061 B2 * 2/2007 Horton ..... F04B 39/121 417/220
8,272,848 B2 9/2012 Gentilin
9,835,146 B2 * 12/2017 DeDecker ..... F04B 45/04
2005/0201880 A1 9/2005 Gentilin
2007/0116579 A1 5/2007 Gentilin

FOREIGN PATENT DOCUMENTS

GB 2062770 A 5/1981
JP 432656 S 1/1968
JP 5270402 6/1977
JP 63168286 U 11/1988
JP 2552654 B2 8/1996
JP 9195927 A 7/1997
JP 2004144022 A 5/2004
JP 2010242698 A 10/2010

* cited by examiner

RECIPROCATING PUMP

CROSS-REFERENCE TO RELATED APPLICATIONS

This application is the United States national phase of International Application No. PCT/JP2015/074673 filed Aug. 31, 2015, and claims priority to Japanese Patent Application No. 2014-209756 filed Oct. 14, 2014, the disclosures of which are hereby incorporated in their entirety by reference in its entirety.

FIELD

The present invention relates to a reciprocating pump configured to deliver fluid to a specific point by reciprocally moving a plurality of piston parts using a single driving source.

BACKGROUND

The aforementioned reciprocating pump is configured to reciprocally move a plurality of piston parts using a single driving source so as to be advantageous in view of the cost. The backward movement of a piston part allows fluid to be drawn into a pump chamber through an inlet port, and the forward movement of the piston part allows the drawn fluid to be discharged through an outlet port.

Specifically, two pump chambers which are provided in the left-right direction, left and right cams which are configured to reciprocally move piston parts provided respectively in the two pump chambers, and a drive unit configured to rotationally drive the left and right cams are provided. The cams are attached to a rotation shaft extending in the left-right direction and having both left and right ends rotatably supported via bearings so as to rotate integrally with the rotation shaft. Further, the drive unit includes a motor, a spur gear on the drive side which is externally fitted to a drive shaft of the motor so as to rotate integrally therewith, and a spur gear on the driven side which is attached to the rotation shaft between the left and right cams so as to be rotatable integrally therewith and mesh with the aforementioned spur gear to transmit a torque to the rotation axes of the cams (see, for example, Patent Literature 1).

CITATION LIST

Patent Literature

Patent Literature 1: Japanese Patent No. 2552654 B2 (see FIG. 1)

SUMMARY

Technical Problem

Patent Literature 1 above requires not only a space to provide the two cams in the left-right direction side-by-side but also a space to provide the bearings that support both left and right ends of the rotation shaft to which the two cams are attached. Further, the rotation shaft needs to be long in the left-right direction so that the spur gear on the driven side configured to transmit power to the rotation shaft can be provided. Therefore, the inconvenience of increasing the size of the entire drive unit in the left-right direction is caused, and thus there is room for improvement.

In view of the aforementioned situation, the present invention aims to solve the problem by providing a reciprocating pump capable of suppressing the increase in size of the entire drive unit, so as to reduce the overall size.

Solution to Problem

In order to solve the aforementioned problem, a reciprocating pump of the present invention includes: a plurality of pump chambers; piston parts provided respectively in the plurality of pump chambers and configured to draw fluid into the pump chambers and discharge the fluid outside the pump chambers by reciprocal movement; a plurality of rotatably driven cams provided corresponding to the number of piston parts and configured to cause the reciprocal movement of the piston parts; and a single motor configured to rotationally drive the plurality of cams, wherein the plurality of piston parts are configured to move in the same direction so as to draw the fluid into the plurality of pump chambers and discharge the fluid, the plurality of pump chambers are provided adjacent to each other, the motor has a drive shaft located between the centers of the piston parts that are located at both ends in the installation direction of the pump chambers so as to be oriented in a direction that is substantially orthogonal to the installation direction of the pump chambers and is substantially orthogonal to the moving direction of the piston parts, or so as to extend in the same direction as the installation direction of the pump chambers, the plurality of cams are aligned adjacent to each other and rotate about an axis that is parallel to the axis of the drive shaft of the motor, and the plurality of cams are linked to the plurality of piston parts so that the plurality of cams respectively cause the reciprocal movement of the plurality of piston parts.

Further, the reciprocating pump of the present invention may have a configuration such that the at least two pump chambers are provided side by side in the left-right direction, the same number of piston parts as the number of the pump chambers are configured to be movable in the front-rear direction that is orthogonal to the left-right direction, and the motor is arranged in the vertical orientation between the center of one of the at least two piston parts that is arranged on one end side in the left-right direction and the center of the other piston part arranged on the other end side in the left-right direction so that the drive shaft of the motor faces <extends?> downward.

Further, the reciprocating pump of the present invention may have a configuration such that the respective piston parts have extending portions provided on their edges on the cam side and configured to extend toward the drive shaft side of the motor, and the extending portions are displaced from each other in the vertical direction so as to abut the cams corresponding to the respective piston parts.

Further, the reciprocating pump of the present invention may have a configuration such that the at least two pump chambers are arranged at substantially the same height position.

Further, the reciprocating pump of the present invention may have a configuration further including guide members configured to guide the reciprocal movement of the piston parts.

Further, the reciprocating pump of the present invention may have a configuration further including: a pump head with which the at least two pump chambers are integrally formed; a body configured to house the drive shaft of the motor and the at least two cams; and a grand flange configured to connect the pump head to the body, wherein the body has an opening for maintenance formed on its sidewall on the pump head side, and the grand flange comprises an openable closing part configured to close the opening.

DESCRIPTION OF EMBODIMENTS

Hereinafter, a reciprocating pump will be described based on the drawings.

Figure 1:
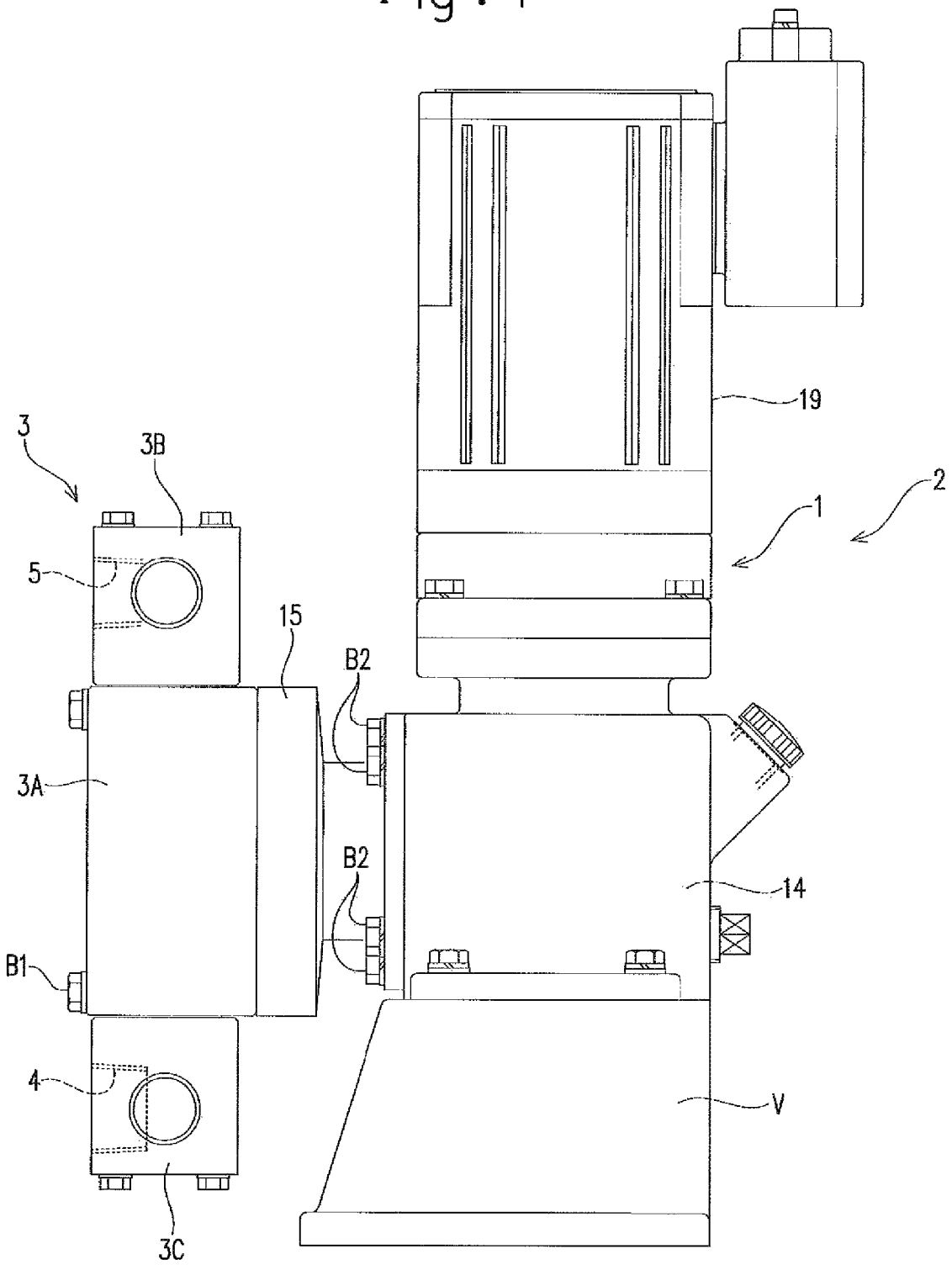
FIG. 1 is a side view of a reciprocating pump.

FIG. 1 shows a diaphragm pump as an example of the reciprocating pump. The diaphragm pump includes a body 2 including a power supply, a control unit, a drive unit 1, and others, and a pump head 3 provided in front of the body 2. The following description will be given on the assumption that, in the pump shown in FIG. 1, the left-right direction of the paper is the front-rear direction, the direction passing through the paper is the left-right direction, and the up-down direction of the paper is the vertical direction.

Figure 2:
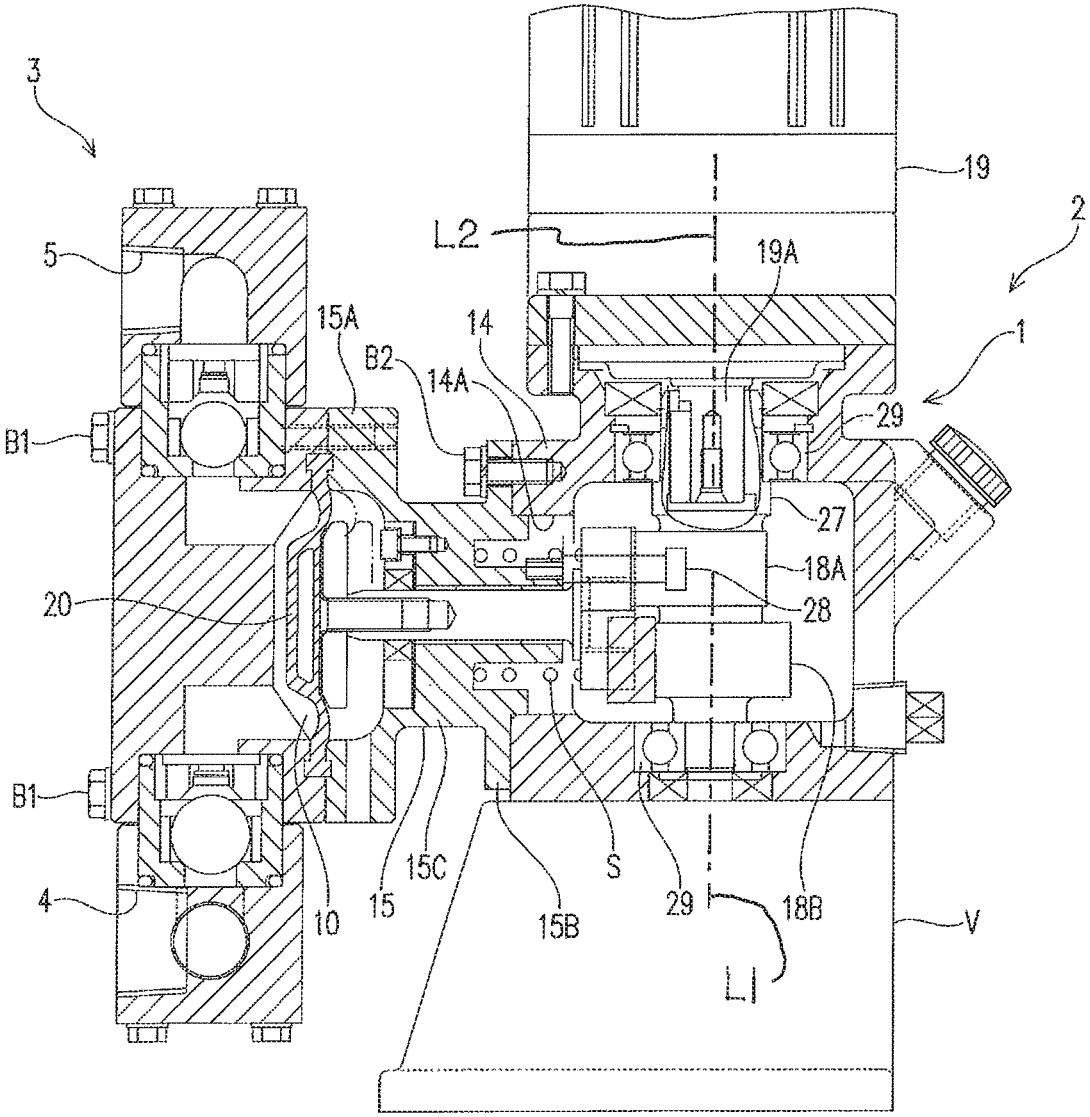
FIG. 2 is a longitudinal sectional side view of the reciprocating pump.
Figure 3:
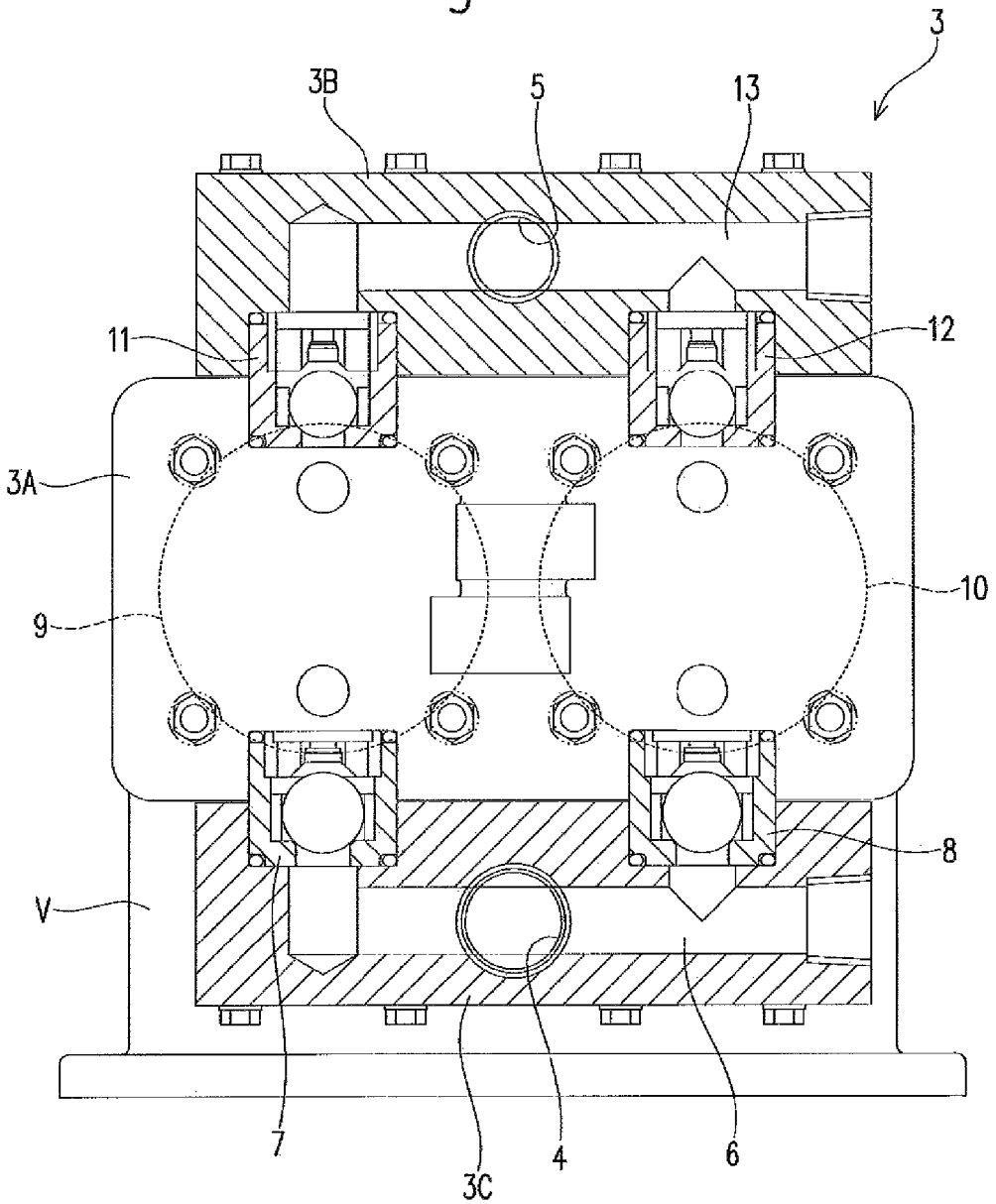
FIG. 3 is a front view of a pump head of the reciprocating pump.

As shown in FIG. 1 to FIG. 3, a fluid inlet port 4 is formed at the center in the left-right direction in the lower part of the pump head 3, and a fluid outlet port 5 is formed at the center in the left-right direction in the upper part of the pump head 3. A hose (not shown) is connected to each of the inlet port 4 and the outlet port 5.

Further, as shown in FIG. 3, the pump head 3 includes an inlet flow path 6 configured to guide fluid from the inlet port 4, a pair of left and right inlet-side check valves 7 and 8 through which the fluid in the inlet flow path 6 is drawn, a left pump chamber 9 and a right pump chamber 10 provided adjacent to each other in the left-right direction so as to draw the fluid through the inlet-side check valves 7 and 8 and discharge it, a pair of left and right outlet-side check valves 11 and 12 configured to respectively discharge the fluid in the two pump chambers 9 and 10, and an outlet flow path 13 configured to guide the fluid discharged through the outlet-side check valves 11 and 12 to the outlet port 5.

Further, the pump head 3 is constituted by three members of a body 3A with which the front portions of the two left and right pump chambers 9 and 10 are integrally formed, and an outlet part 3B and an inlet part 3C which are fixed to the top and the bottom of the body 3A. The two pump chambers 9 and 10 can be formed more closely in the left-right direction by forming the two pump chambers 9 and 10 integrally with the body 3A, and thus the size of the pump in the left-right direction can be reduced. Moreover, the dimension of the body 3A in the vertical direction also can be reduced by arranging the two pump chambers 9 and 10 at the same height position, as compared with the arrangement in which the two pump chambers are displaced in the vertical direction.

Further, a grand flange 15 with which the rear portions of the two pump chambers 9 and 10 on the left and right sides are integrally formed is provided. The grand flange 15 is a coupling member connecting the pump head 3 to the body 2 housing the drive unit 1 (including a drive shaft 19A of an electric motor 19, two cams 18A and 18B, and the like, which will be described below). Further, provided are a flange 15A located on the front side and connected by bolts B1 to the rear edge of the body 3A of the pump head 3, a flange (closing part) 15B located on the rear side and connected by bolts B2 to a casing 14 constituting the body 2 that houses the drive unit 1, so as to close a front opening 14A for maintenance that is formed on a sidewall on the pump head side of the casing 14, and a coupling part 15C coupling these front and rear flanges 15A and 15B together. Accordingly, the front opening 14A of the casing 14 is opened by detaching the grand flange 15 from the casing 14, and the maintenance of the drive unit 1 in the casing 14 can be quickly performed through the opening 14A. The coupling part 15C of the grand flange 15 has a cylindrical shape so as to connect the pump head 3 to the casing 14, and serves also as a support member configured to guide a shaft 21, which will be described below, by allowing it to slide thereon. The casing 14 is fixed onto the top of a base member V that is substantially trapezoid in side view.

The drive unit 1 includes piston parts 16 and 17 provided respectively in the two pump chambers 9 and 10 and configured to draw fluid into the pump chambers 9 and 10 by reciprocal movement and discharge it outside the pump chambers 9 and 10, the cams (which herein are two eccentric cams) 18A and 18B provided corresponding to the number of the piston parts 16 and 17 and configured to be rotatably driven so as to reciprocally move the two piston parts 16 and 17, and the single electric motor 19 configured to rotationally drive the two cams 18A and 18B.

Each piston part 16 or 17 includes a diaphragm 20 provided as a piston in the pump chamber 9 or 10, the shaft 21 or 22 projecting backward from the diaphragm 20 to cause the diaphragm 20 to pump, and an extending portion 23 provided on the edge on the cam side (rear edge) of the shaft 21 or 22 so as to abut the cam 18A or 18B. The diaphragm 20 is made of an elastically deformable material such as rubber, and the fluid can be drawn and discharged by the elastic deformation of the diaphragm 20.

In each diaphragm 20, a disk part 24 made of metal is embedded by insert molding. A stem part 25 projecting from the rear edge of the disk part 24 toward the shaft 21 or 22 side is integrally formed with the disk part 24. The stem part 25 is configured to have a smaller diameter than the shaft 21 or 22, and the stem part 25 connects the diaphragm 20 to the shaft 21 or 22 by being screwed into a screw hole formed in the shaft 21 or 22. Further, the stem part 25 passes through a disk member 26, and the front end of the shaft 21 or 22 abuts the disk member 26 by screwing the stem part 25 into the screw hole formed in the shaft 21 or 22. Thereby, the disk member 26 is pressed toward the diaphragm 20 side to be fixed.

The cams 18A and 18B are integrally formed with a cam shaft 27 that is externally fitted to the drive shaft 19A of the electric motor 19 so as to integrally rotate therewith, so that the cams 18A and 18B are adjacent to each other in the vertical direction. The cams 18A and 18B are aligned adjacent to each other and rotate about an axis L1 that is parallel to the axis L2 of the drive shaft 19A. The cams 18A and 18B form cam faces so that, when the cam 18A on one side is pressing the shaft 21 on one side toward the front side, the cam 18B on the other side retracts from the shaft 22 on the other side toward the rear side. A pump with low pulsation can be constituted by forming the cam faces as above. Both the upper and lower ends of the cam shaft 27 are rotatably supported by bearings 29 provided at the top and bottom of the casing 14.

Figure 4:
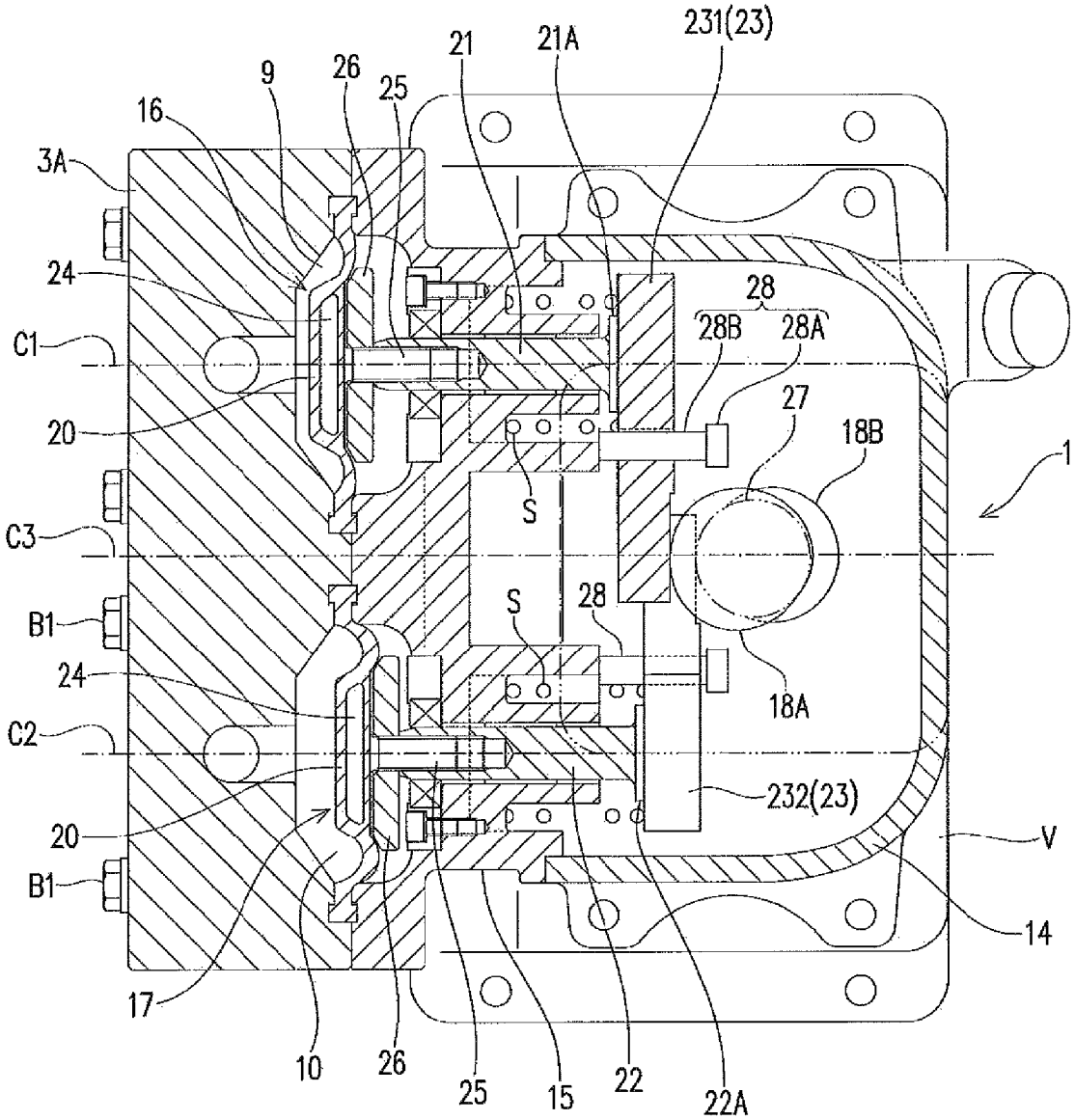
FIG. 4 is a cross sectional plan view of the reciprocating pump.

As shown in FIG. 4, the drive shaft 19A of the electric motor 19 is oriented in the vertical direction between a center C1 of the piston part 16 on one end side (left end) in the left-right direction of the two piston parts 16 and 17 and a center C2 of the piston part 17 on the other end side (right end) in the left-right direction thereof. Here, the drive shaft 19A is located at a center C3 in the left-right direction between the center C1 of the piston part 16 on one side and the center C2 of the piston part 17 on the other side. Accordingly, the outline of the electric motor 19 does not project over the outline of the casing 14 in plan view.

Figure 5:
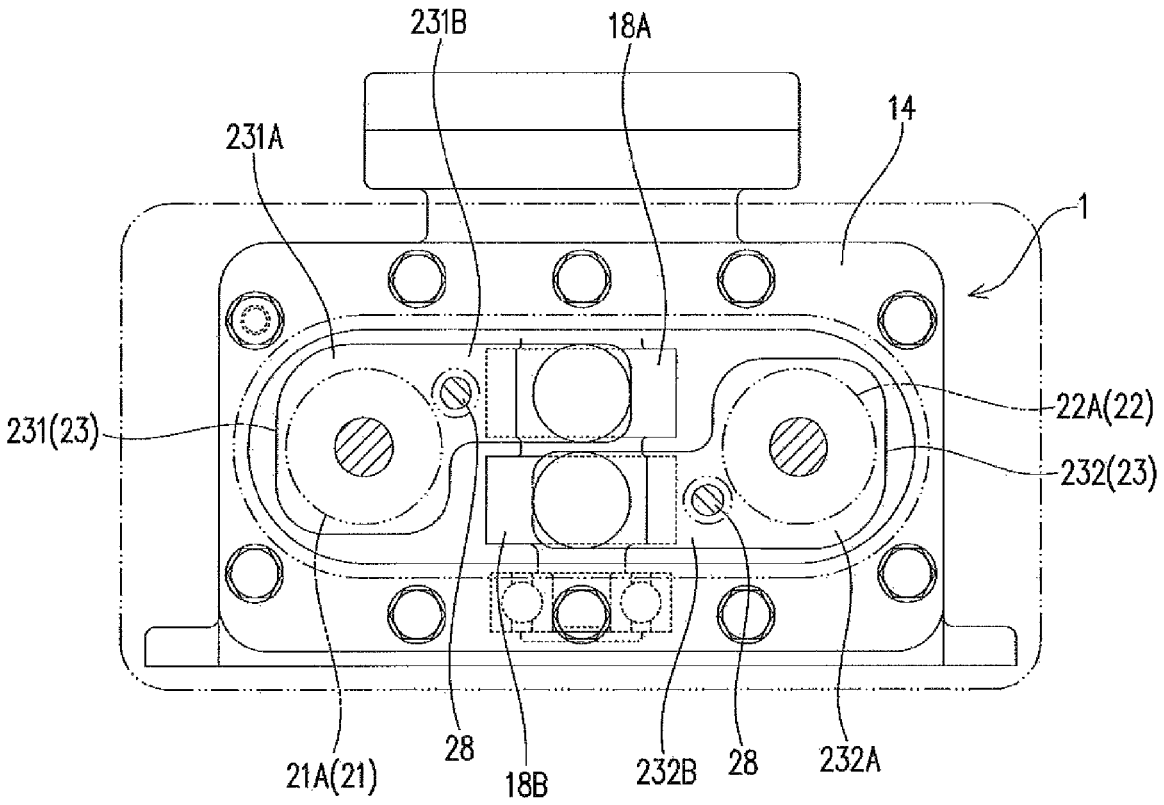
FIG. 5 is a front view of a main part of a drive unit of the reciprocating pump from which the pump head is detached.

As shown in FIG. 4 and FIG. 5, the extending portions 23 are composed of a substantially L-shaped first extending portion 231 constituted by a substantially square first body 231A connected to a large-diameter disk part 21A at the end on the cam side of the shaft 21 of the piston part 16 on one side and a substantially rectangular first horizontal part 231B extending from the upper edge of the first body 231A toward the side of the piston part on the other side, and a substantially L-shaped second extending portion 232 constituted by a substantially square second body 232A connected to a large-diameter disk part 22A at the end on the cam side of the shaft 21 of the piston part 17 on the other side and a substantially rectangular second horizontal part 232B extending from the lower edge of the second body 232A toward the first piston part side. Further, the arrangement is such that the first horizontal part 231B of the first extending portion 231 and the second horizontal part 232B of the second extending portion 232 are adjacent to each other in the vertical direction. Such an arrangement in which the first horizontal part 231B of the first extending portion 231 and the second horizontal part 232B of the second extending portion 232 are adjacent to each other in the vertical direction can reduce the space to arrange the two extending portions 231 and 232 in the vertical direction, and can reduce the size of the drive unit in the vertical direction to such an extent. Further, the first extending portion 231 and the second extending portion 232 are movably biased to the sides of the cams 18A and 18B by coil springs S. Accordingly, the first extending portion 231 and the second extending portion 232 are configured to constantly abut the circumferential surfaces of the cams 18A and 18B.

Further, the dimensions in the vertical direction of the first horizontal part 231B and the second horizontal part 232B are substantially the same as the dimensions in the vertical direction of the vertically disposed cams 18A and 18B. Such setting of the dimensions can increase the portions where the first horizontal part 231B and the second horizontal part 232B contact with the vertically disposed cams 18A and 18B in the vertical direction. As a result, the shafts 21 and 22 can be smoothly moved. Further, the dimensions in the vertical direction of the first body 231A and the second body 232A can be configured to be slightly larger than the diameter dimensions of the large-diameter disk parts 21A and 22A at the ends on the cam side of the vertically disposed shafts 21 and 22, and the dimensions in the vertical direction of the first horizontal part 231B and the second horizontal part 232B can be set to a substantially half (preferably, the half or less) of the dimensions in the vertical direction of the first body 231A and the second body 232A, so as to prevent (or reduce) the projection of the first horizontal part 231B and the second horizontal part 232B over the upper and lower edges of the first body 231A and the second body 232A in the vertical direction in side view.

A guide member 28 configured to guide the reciprocal movement of each piston part 16 or 17 is provided. The guide member 28 is made of a rod member having a circular cross section and passes through the horizontal part 231B or 232B, and the distal end of the guide member 28 passing therethrough is fixed to the grand flange 15. In particular, when the free end (part configured to move away from the shaft 21 or 22) of the horizontal part 231B or 232B is pressed by the cam 18A or 18B to move the piston part 16 or 17 forward, deflection and deformation of the shaft 21 or 22 can be prevented. Further, when the stem part 25 is screwed into the shaft 21 or 22 in order to set the diaphragm 20 into the shaft 21 or 22, the rotation of the shaft 21 or 22 in conjunction with the rotation of the stem part 25 can be prevented by providing the guide member 28. A head 28A having a larger diameter than a stem portion 28B is provided at the end of the guide member 28, but may be omitted.

As described above, as compared with the configuration in which the two cams 18A and 18B are provided on the rotation shaft supported via bearings in the left-right direction, the arrangement in which the two pump chambers 9 and 10 are provided adjacent to each other, the drive shaft 19A of the electric motor 19 is located between the centers of the piston parts 16 and 17 that are located at both ends in the installation direction of the pump chambers 9 and 10 so as to be oriented in a direction that is substantially orthogonal to the installation direction of the pump chambers 9 and 10 and is orthogonal to the moving direction of the piston parts 16 and 17, and the two cams 18A and 18B are arranged adjacent to each other on the drive shaft 19A of the electric motor 19 can eliminate the need for the space to provide the two cams 18A and 18B in the left-right direction and the space to provide the bearings, and also can eliminate the need for providing a gear on the driven side on the rotation shaft in order to interlock the drive shaft 19A of the electric motor 19 with the rotation shaft, so that the increase of the dimension in the left-right direction of the drive unit 1 can be suppressed to such an extent. Further, the two cams 18A and 18B are arranged adjacent to each other on the drive shaft 19A, and therefore the configuration of linking the two cams 18A and 18B respectively to the two piston parts 16 and 17 so as to reciprocally move the two piston parts 16 and 17 also can suppress the increase of the size in the vertical direction. Accordingly, the increase of the dimension in the vertical direction of the drive unit can be suppressed.

Next, using the diaphragm pump configured as above, the operation of delivering fluid by drawing a certain amount of fluid each time will be described.

First, the electric motor 19 is driven, and the driving force is transmitted to the drive shaft 19A. The transmitted driving force causes the cam shaft 27 to rotate about the vertical axis so as to rotate the two cams 18A and 18B. The rotation of the cams 18A and 18B causes the reciprocal movement of the first and second piston parts 16 and 17.

The reciprocal movement of the piston parts 16 and 17 causes elastic deformation of the diaphragms 20 to draw and discharge the fluid. In FIG. 4, the piston part 17 on the right side (one side) moves to the backward movement side (the rear side) to draw fluid into the right pump chamber 10. In response to this movement, the piston part 16 on the left side (the other side) moves to the forward movement side (the front side) to discharge fluid in the left pump chamber 9. In this way, the operation of drawing fluid into one of the pump chambers 9 and 10 and discharging fluid that has been drawn in the other of the pump chambers 10 and 9 is repeated, so that a certain amount of fluid is drawn each time to deliver it.

The present invention is not limited to the aforementioned embodiment, and various modifications can be made without departing from the gist of the present invention.

In the aforementioned embodiment, the diaphragm is used as a piston, but a plunger may be used. In this case, the configuration can be such that one of the two pistons is a plunger and the other is a diaphragm, or both of them may be configured as plungers.

Further, in the aforementioned embodiment, the case of using the two piston parts is shown, but a pump may be constituted by using three or more piston parts.

Further, in the aforementioned embodiment, the pump chambers 9 and 10 are arranged in the left-right direction, but a plurality of pump chambers may be provided in the vertical direction. In the case of providing a plurality of pump chambers in the vertical direction, the electric motor is arranged so that the drive shaft of the electric motor is oriented in the left-right direction.

Further, in the aforementioned embodiment, the electric motor 19 is arranged so that the drive shaft 19A of the electric motor 19 faces downward, but the electric motor 19 may be arranged so that the drive shaft 19A faces upward.

Figure 6A:
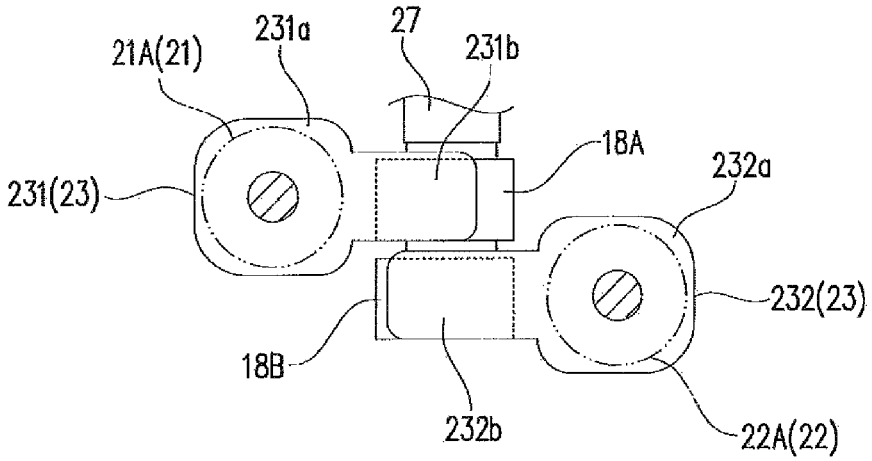
FIG. 6A, FIG. 6B, and FIG. 6C are schematic front views of other three embodiments showing the relationship between cams and extending portions.

Further, in the aforementioned embodiment, the two shafts 21 and 22 are arranged at the same height position, but the left shaft 21 may be arranged higher than the right shaft 22, as shown in FIG. 6A. In this case, the extending portions 23 abutting the vertically disposed cams 18A and 18B are composed of the first extending portion 231 constituted by a substantially square first body 231*a* connected to the large-diameter disk part 21A at the end on the cam side of the shaft 21 on one side and a substantially rectangular first horizontal part 231*b* extending from the vertical center of the edge (the right edge in the figure) on the shaft 22 side on the other side of the first body 231*a* toward the shaft 22 side on the other side, and the second extending portion 232 constituted by a substantially square second body 232*a* connected to the large-diameter disk part 22A at the end on the cam side of the shaft 22 on the other side and the substantially rectangular second horizontal part 232*b* extending from the vertical center of the edge (the left edge in the figure) on the shaft 21 side on one side of the second body 232*a* toward the shaft 21 side on one side.

Figure 6B:
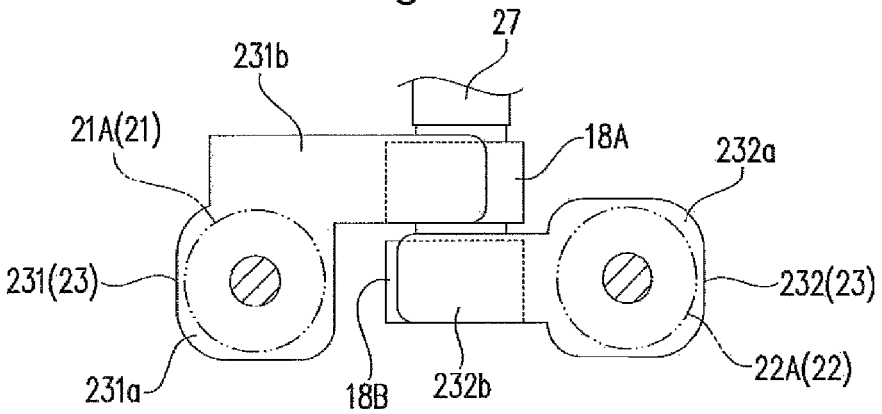

Further, in the aforementioned embodiment, the first horizontal part 231B and the second horizontal part 232B are configured so as not to project over the upper and lower edges of the first body 231A and the second body 232A in the vertical direction in side view, but the first horizontal part 231*b* on one side (which is the left side in the figure, but may be the right side) may be configured to extend toward the second body 232*a* side on the other side, while projecting upwardly over the upper edge of the first body 231*a* in side view, as shown in FIG. 6B. In FIG. 6B, the case where the first horizontal part 231*b* projects upwardly over the upper edge of the first body 231*a*, but the first horizontal part 231*b* may be configured to project downwardly over the lower edge of the first body 231*a*.

Figure 6C:
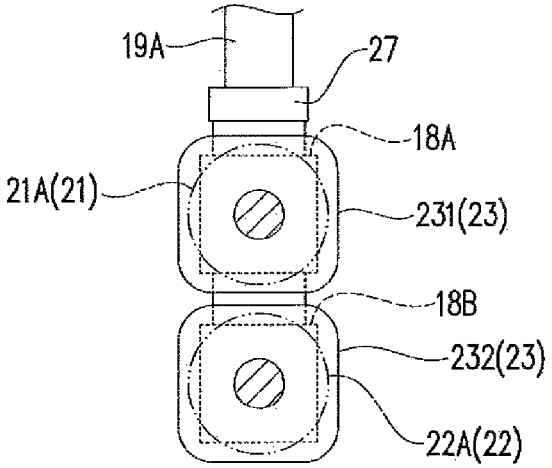

Further, in the aforementioned embodiment, the drive shaft 19A of the electric motor 19 is located between the centers of the piston parts 16 and 17 that are located at both ends in the installation direction of the pump chambers 9 and 10, so as to be oriented in a direction that is substantially orthogonal to the installation direction of the pump chambers 9 and 10 and is substantially orthogonal to the moving direction of the piston parts 16 and 17, but the drive shaft 19A of the electric motor 19 may be arranged so as to extend in the same direction as the installation direction (the vertical direction in the figure) of the pump chambers, as shown in FIG. 6C. With such a configuration, the extending portions 23 shown in FIG. 5, FIG. 6A, and FIG. 6B are configured as substantially square plate members 231 and 232 that are slightly larger than the large-diameter disk parts 21A and 22A at the ends on the cam side of the shafts 21 and 22. Then, the cams 18A and 18B abut the center portions in the left-right direction of the plate members 231 and 232, thereby stably pressing the shafts 21 and 22 without deflection.

Figure 7:
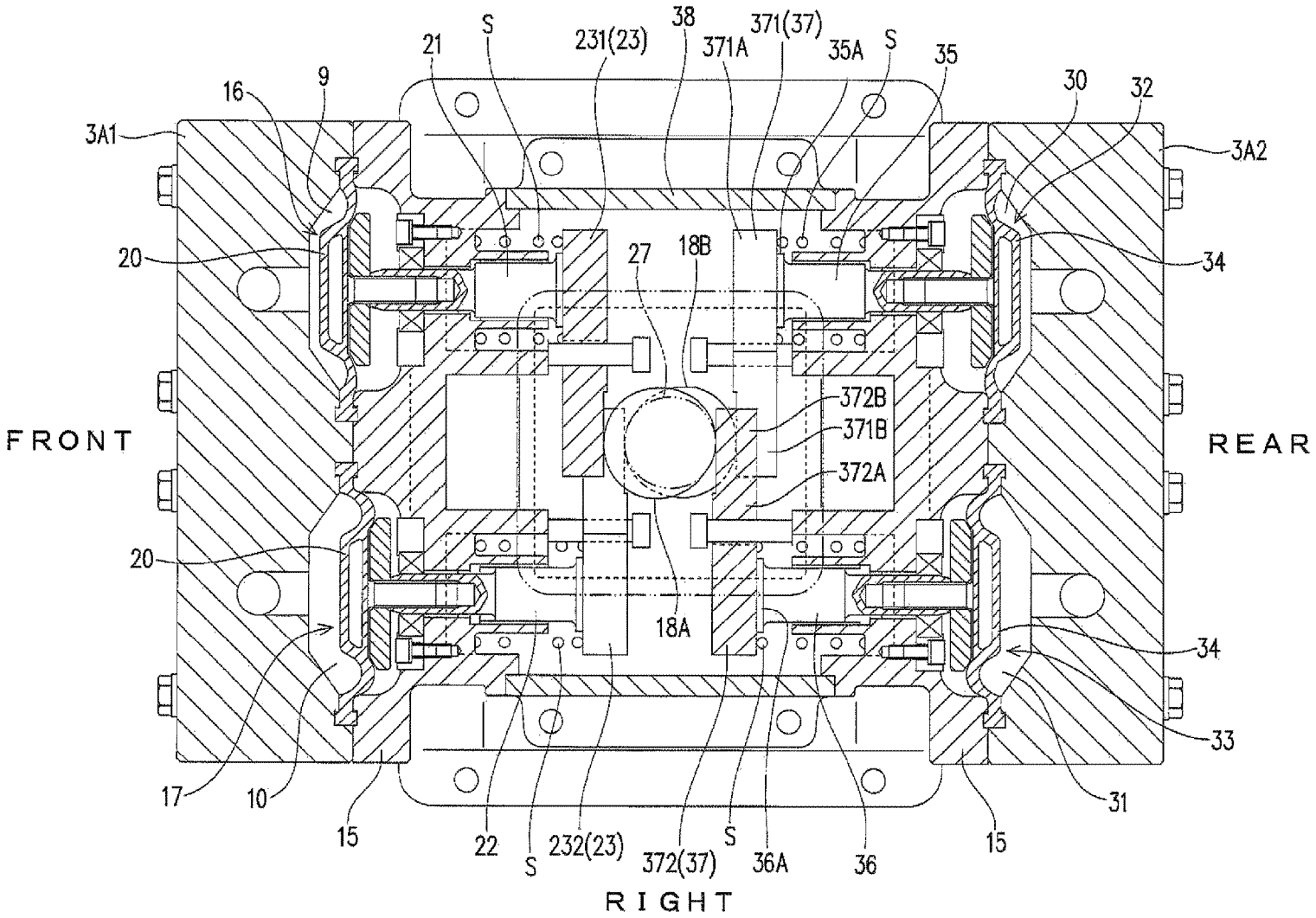
FIG. 7 is a cross sectional plan view of another embodiment of the reciprocating pump.

Further, in the aforementioned embodiment, a configuration in which the two pump chambers (hereinafter, referred to as the first pump chambers) 9 and 10 are provided in the left-right direction is shown, but an embodiment of providing four pump chambers 9, 10, 30, and 31 in total by providing a plurality (herein two) of second (other) pump chambers 30 and 31 so as to face the left and right pump chambers 9 and 10 in the front-rear direction with the same number (herein two) of cams 18A and 18B interposed therebetween is also possible. In FIG. 7, characters indicating the front, rear, left, and right sides are shown in the figure for the ease of description.

The second pump chamber 30 or 31 includes a second piston part 32 or 33 configured to be reciprocally moved by one of the plurality (two) of cams 18A and 18B. Fluid is drawn into the second pump chamber 30 or 31 and is discharged outside the second pump chamber 30 or 31, by the reciprocal movement of the second piston part 32 or 33. Each second piston part 30 or 31 includes a diaphragm 34 provided as a piston in the second pump chamber 30 or 31, a shaft 35 or 36 projecting forward from the diaphragm 34 to cause the diaphragm 34 to pump, and an extending portion 37 provided at the end on the cam side (front end) of the shaft 35 or 36 so as to abut the cam 18A or 18B.

The diaphragm 34 is made of an elastically deformable material such as rubber, and the fluid can be drawn and discharged by the elastic deformation of the diaphragm 34. The extending portions 37 are composed of a substantially L-shaped first extending portion 371 constituted by a substantially square first body 371A connected to a large-diameter disk part 35A at the end on the cam side of the shaft 35 of the second piston part 32 on one side and a substantially rectangular first horizontal part 371B extending from the lower edge of the first body 371A toward the second piston part side on the other side, and a substantially L-shaped second extending portion 372 constituted by a substantially square second body 372A connected to a large-diameter disk part 36A at the end on the cam side of the shaft 36 of the second piston part 33 on the other side and a substantially rectangular second horizontal part 372B extending from the upper edge of the second body 372A toward the second piston part side on one side. Further, as described above, the arrangement is such that the first horizontal part 371B of the first extending portion 371 and the second horizontal part 372B of the second extending portion 372 are adjacent to each other in the vertical direction. Further, the first extending portion 371 and the second extending portion 372 are movably biased to the sides of the cams 18A and 18B by coil springs S. Accordingly, the first extending portion 371 and the second extending portion 372 are configured to constantly abut the circumferential surfaces of the cams 18A and 18B. In FIG. 7, two bodies 3A1 and 3A2 are provided on the front and rear ends of the reciprocating pump, two grand flanges 15 as described above (see FIG. 4) are provided on the rear end of the body 3A1 and on the front end of the body 3A2, and the open ends of the two grand flanges 15 are closed by a casing 38.

As described above, in the four pump chambers 9, 10, 30, and 31, fluid in the two pump chambers 9 and 30 is discharged, and fluid is drawn into the other two pump chambers 10 and 31. After this operation, fluid is drawn into the two pump chambers 9 and 30, and the fluid in the other two pump chambers 10 and 31 is discharged. This configuration allows the fluid in the two pump chambers to be constantly and concurrently discharged by repeating these operations, but the timing of discharging may be changed. In FIG. 7, the configuration is such that fluid in the two pump chambers 9 and 30 located on the left side in the pump chambers that are opposed in the front-rear direction is discharged, and fluid is drawn into the other two pump chambers 10 and 31 located on the right side in the pump chambers that are opposed in the front-rear direction, but the configuration may be such that, in the four pump chambers 9, 10, 30, and 31 located at the four corners of the reciprocating pump, fluid in the two pump chambers 9 and 31 located on one diagonal line is discharged, and fluid is drawn into the two pump chambers 10 and 30 located on the other diagonal line. Further, in FIG. 7, the four pump chambers 9, 10, 30, and 31 are shown, but embodiments of providing six and eight pump chambers are also possible. In the case of using six pump chambers, the embodiment would be such that two pump chambers are further provided above or below the four pump chambers 9, 10, 30, and 31 shown in FIG. 7, and one drive cam corresponding to the two pump chambers is provided in an extending portion obtained by extending the cam shaft 27 upwardly or downwardly. Further, in the case of using eight pump chambers, the embodiment would be such that four pump chambers having the same configuration are further provided above or below the four pump chambers 9, 10, 30, and 31, and two drive cams corresponding to the four pump chambers are provided in an extending portion obtained by extending the cam shaft 27.

REFERENCE SIGNS LIST

1: Drive unit
2: Body
3: Pump head
3A, 3A1, 3A2: Body
3B: Outlet part
3C: Inlet part
4: Inlet port
5: Outlet port
6: Inlet flow path
7, 8: Inlet-side check valve
9, 10, 30, 31: Pump chamber
11, 12: Outlet-side check valve
13: Outlet flow path
14: Casing
14A: Opening
15: Grand flange
15A, 15B: Flange
15C: Coupling part
16, 17: Piston part
18A, 18B: Cam
19: Electric motor
19A: Drive shaft
20, 34: Diaphragm
21, 22, 35, 36: Shaft
23, 37: Extending portion
38: Casing
24: Disk part
25: Stem part
26: Disk member
27: Cam shaft
28: Guide member
28A: Head
28B: Stem portion
29: Bearing
231, 232, 371, 372: Extending portion (plate member)
231A, 232A, 371A, 372A: Body
231B, 232B, 371B, 372B: Horizontal part
B1, B2: Bolt
C1, C2: Center
C3: Center
S: Coil spring
V: Base member

The invention claimed is:

1. A reciprocating pump comprising:

a plurality of pump chambers;

piston parts provided respectively in the plurality of pump chambers and configured to draw fluid into the pump chambers and discharge the fluid outside the pump chambers by reciprocal movement;

a plurality of rotatably driven cams provided corresponding to the number of piston parts and configured to cause the reciprocal movement of the piston parts; and a single motor configured to rotationally drive the plurality of cams, wherein the plurality of piston parts are configured to move in the same direction so as to draw the fluid into the plurality of pump chambers and discharge the fluid, the plurality of pump chambers are provided adjacent to each other, the motor has a drive shaft located between the centers of the piston parts that are located at both ends in the installation direction of the pump chambers so as to be oriented in a direction that is substantially orthogonal to the installation direction of the pump chambers and is substantially orthogonal to the moving direction of the piston parts, the plurality of cams are aligned adjacent to each other and rotate about an axis that is parallel to the axis of the drive shaft of the motor, and the plurality of cams are linked to the plurality of piston parts so that the plurality of cams respectively cause the reciprocal movement of the plurality of piston parts, wherein the at least two pump chambers are provided side by side in a left-right direction, the same number of piston parts as the number of the pump chambers are configured to be movable in a front-rear direction that is orthogonal to the left-right direction, the motor is arranged in a vertical orientation between the center of one of the at least two piston parts that is arranged on one end side in the left-right direction and the center of the other piston part arranged on the other end side in the left-right direction so that the drive shaft of the motor faces downward, and the respective piston parts have extending portions provided on their edges on the cam side and configured to extend toward the drive shaft side of the motor, and the extending portions are displaced from each other in the vertical direction so as to abut the cams corresponding to the respective piston parts.

2. The reciprocating pump according to claim 1, wherein the at least two pump chambers are arranged at substantially the same height position.

3. The reciprocating pump according to claim 1, further comprising:

guide members configured to guide the reciprocal movement of the piston parts.

4. The reciprocating pump according to claim 1, further comprising:

a pump head with which the at least two pump chambers are integrally formed;

a body configured to house the drive shaft of the motor and the at least two cams; and a grand flange configured to connect the pump head to the body, wherein the body has an opening for maintenance formed on its sidewall on the pump head side, and the grand flange comprises an openable closing part configured to close the opening.

5. The reciprocating pump according to claim 1, wherein the at least two pump chambers are arranged at substantially the same height position.

6. The reciprocating pump according to claim 1, wherein the piston parts respectively have extending portions provided so as to abut the respective cams.

7. The reciprocating pump according to claim 6, further comprising:

a plurality of coil springs, wherein the extending portions are movably biased to the sides of the cams by the coil springs.

* * * * *